US010365021B2

(12) United States Patent
Park et al.

(10) Patent No.: US 10,365,021 B2
(45) Date of Patent: Jul. 30, 2019

(54) COOLING APPARATUS AND COMPRESSOR

(71) Applicant: SAMSUNG ELECTRONICS CO., LTD., Suwon-si (KR)

(72) Inventors: Soo Dol Park, Suwon-si (KR); Jeong Bae Lee, Hwaseong-si (KR); Min-Soo Yang, Suwon-si (KR); Chi Dae Yang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 624 days.

(21) Appl. No.: 14/598,377

(22) Filed: Jan. 16, 2015

(65) Prior Publication Data

US 2015/0204587 A1 Jul. 23, 2015

(30) Foreign Application Priority Data

Jan. 23, 2014 (KR) ..... 10-2014-0008552

(51) Int. Cl.
*F25B 31/02* (2006.01)
*F25B 1/04* (2006.01)

(52) U.S. Cl.
CPC ..... *F25B 31/02* (2013.01); *F25B 1/04* (2013.01); *F25B 31/026* (2013.01); *F25B 2400/12* (2013.01); *F25B 2400/121* (2013.01)

(58) Field of Classification Search
CPC ..... F25B 31/02; F25B 31/04; F25B 31/026; F25B 2400/121; F25B 2400/12; F25B 43/006; F04C 18/3564; F04C 23/008
See application file for complete search history.

(56) References Cited

U.S. PATENT DOCUMENTS 4,601,643 A * 7/1986 Seidel ..... F01C 11/00 417/247
4,605,362 A * 8/1986 Sturgeon ..... B23K 9/0026 219/73

(Continued)

FOREIGN PATENT DOCUMENTS

CN 1371453 A 9/2002
CN 1761817 A 4/2006

(Continued)

OTHER PUBLICATIONS

1998 ASHRAE Refrigeration Handbook, Chapter 2, "System Practices for halocarbon refrigerants".

(Continued)

*Primary Examiner* — Frantz F Jules
*Assistant Examiner* — Martha Tadesse
(74) *Attorney, Agent, or Firm* — Staas & Halsey LLP

(57) ABSTRACT

A cooling apparatus includes a compressor; a condenser for condensing a refrigerant discharged from the compressor, an expansion valve to expand the refrigerant discharged from the condenser, and an evaporator to evaporate the refrigerant discharged from the expansion valve and to deliver the refrigerant to the compressor. The compressor includes a rotary compressor having a displacement volume less than about 3 cc, and refrigerant circulating inside the cooling apparatus includes at least one of R290, R600a, R123a, R1234yf, and R1234ze. The cooling apparatus and compressor attain miniaturization and high efficiency.

13 Claims, 6 Drawing Sheets

(56) References Cited

U.S. PATENT DOCUMENTS 4,902,205 A * 2/1990 DaCosta ..... F04C 5/00 417/372
5,022,146 A * 6/1991 Gannaway ..... F04C 23/001 138/26
5,226,797 A * 7/1993 Da Costa ..... F04C 29/028 418/150
6,447,274 B1 * 9/2002 Horihata ..... F01C 21/104 29/888.025
7,281,914 B2 * 10/2007 Lee ..... F04C 14/065 417/218
7,473,081 B2 * 1/2009 Ogasawara ..... F04C 23/008 184/6.18
8,857,211 B2 * 10/2014 Morozumi ..... F04C 18/3442 62/467
2002/0150493 A1 * 10/2002 Matsumoto ..... C10M 171/008 418/63
2006/0140791 A1 * 6/2006 Deming ..... F04C 18/3564 417/410.3
2007/0243079 A1 * 10/2007 Lee ..... F01C 21/0863 417/279
2008/0078191 A1 * 4/2008 Morishita ..... F04C 18/3564 62/126
2008/0092586 A1 * 4/2008 Kitaichi ..... F04C 14/26 62/498
2008/0112831 A1 * 5/2008 Ogasawara ..... F04C 23/008 418/97
2008/0120985 A1 * 5/2008 Lee ..... F04C 23/001 62/228.1
2009/0038150 A1 * 2/2009 Kishikawa ..... B23K 33/006 29/888.02
2009/0260376 A1 * 10/2009 Kasahara ..... F25B 49/005 62/149
2010/0017037 A1 * 1/2010 Nam ..... F25B 49/025 700/275
2011/0123361 A1 * 5/2011 Byun ..... F01C 21/0863 417/199.1
2011/0138848 A1 * 6/2011 Byun ..... F01C 1/3564 62/498
2012/0189482 A1 * 7/2012 Kishikawa ..... F04C 18/356 418/179
2016/0281717 A1 * 9/2016 Komai ..... F04D 3/00

FOREIGN PATENT DOCUMENTS

CN 101490485 A 7/2009
CN 101514696 A 8/2009
EP 2 093 525 A2 8/2009
EP 2093525 A2 * 8/2009 ..... F04C 18/3564
EP 2093525 A2 * 8/2009 ..... F04C 18/3564
KR 10-2007-0086950 8/2007
WO 2006/073048 A1 7/2006

OTHER PUBLICATIONS

Rapin "Installations frigorifiques Tome 2", vol. 2, Mar. 1, 1988, pp. 251-258.
European Search Report dated Jul. 20, 2015 in corresponding European Patent Application No. 15151333.0.
Chinese Office Action dated Mar. 29, 2018, in corresponding Chinese Patent Application No. 201510033002.5, 18 pgs.
Chinese Patent Office issued Notice of Allowance in Chinese Patent Application No. 201510033002.5 dated Nov. 15, 2018 (4 pages total).

* cited by examiner

COOLING APPARATUS AND COMPRESSOR

CROSS-REFERENCE TO RELATED APPLICATIONS

This application claims the benefit under 35 U.S.C. § 119(a) of a Korean Patent Application No. 10-2014-0008552, filed on Jan. 23, 2014 in the Korean Intellectual Property Office, the entire disclosure of which is hereby incorporated by reference.

BACKGROUND

1. Field

The present disclosure relates generally to a cooling apparatus and compressor, and more particularly, to a cooling apparatus and compressor that attains miniaturization and high efficiency.

2. Description of the Related Art

General cooling apparatuses generally use a refrigerant cycle to control temperature to be suitable for human activities. A compressor, a condenser, a evaporator, and an expansion valve may be main components for the refrigerant cycle.

The compressor, one of the main components for the refrigerant cycle, compresses a refrigerant with power delivered from a driving device like an electric motor. The compressor is classified into a positive displacement compressor and a turbo compressor based on compression methods. The positive displacement compressor includes a rotary compressor to compress a fluid with a rolling piston that eccentrically rotates within a cylinder.

The rotary compressor includes a casing having an airtight receptive space, an inlet and an outlet, a driving unit mounted inside the casing, and a compression unit coupled to the driving unit for compressing refrigerant. The rotary compressor has good volumetric efficiency as compared to a reciprocating compressor, thus having higher compression efficiency.

As single-person and two-person households increase these days, cooling apparatuses utilized as appliances need to reflect the trend as well. There are various small cooling devices on the market, and thus a need exists for making them have higher efficiency and mobility.

SUMMARY

Embodiments of the present disclosure provide a cooling apparatus and compressor that attains miniaturization and high efficiency.

Embodiments of the present disclosure also provide a cooling apparatus and compressor that restricts behaviors of their components for reliable operation.

In accordance with an aspect of the present disclosure, a cooling apparatus is provided. The cooling apparatus includes a compressor; a condenser for condensing a refrigerant discharged from the compressor; an expansion valve for expanding the refrigerant discharged from the condenser; and an evaporator for evaporating the refrigerant discharged from the expansion valve and delivering the refrigerant to the compressor, wherein the compressor comprises a rotary compressor having a displacement volume less than about 3 cubic centimeters (cc), and wherein the refrigerant circulating inside the cooling apparatus includes at least one of R290, R600a, R123a, R1234yf, and R1234ze.

Cooling performance of the cooling apparatus may be less than about 2 kilowatts (kW).

The compressor, the condenser, the expansion valve, and the evaporator may be connected by pipes, wherein the pipes may include liquid-side pipes that connect the evaporator and the compressor, and the compressor and the condenser, and gas-side pipes that connect the condenser and the expansion valve, and the expansion valve and the evaporator, wherein the liquid-side pipe may have internal diameter less than about 4.2 mm, and wherein the gas-side pipe may have internal diameter less than about 6.5 mm.

The condenser and the evaporator may include heat transfer pipes in which the refrigerant undergoes heat exchange while flowing through the heat transfer pipes, wherein the heat transfer pipes may include a condensation heat transfer tube formed in the condenser and evaporation heat transfer tube formed in the evaporator, wherein the condensation heat transfer tube may have internal diameter less than about 5.0 mm, and wherein the evaporation heat transfer tube may have internal diameter less than about 7.0 mm.

A weight of the compressor may be less than about 1.5 kilograms (kg).

The compressor may have internal diameter less than about 70 mm.

A shaft length of the compressor may be less than about 170 mm.

The compressor may include a casing for storing oil, and wherein the oil has dynamic viscosity ranging from about 68 $mm^2/s$ to about 170 $mm^2/s$.

The oil may include at least one of Polyol ester (POE) and Polyvinyl ether (PVE).

The compressor may include a compression unit for compressing the refrigerant and a driving unit for delivering power to the compression unit, wherein the driving unit may operate at a speed less than about 6,500 rotations per minute (rpm).

The compressor may include a casing and a compression unit formed inside the casing, wherein the compression unit may include at least four separate spot welds for combining the compression unit to an internal part of the casing.

The compression unit may include at least one cylinder and plates arranged on the top and bottom of the at least one cylinder to form at least one compression room, wherein the spot welds may be located on the plate and the at least one cylinder.

The at least one cylinder may include a first cylinder and a second cylinder located between the first cylinder and the bottom of the casing, wherein the spot welds may be located on the plate and the second cylinder.

The cooling apparatus may further include an accumulator installed on a side of the compressor for having the refrigerant discharged from the evaporator separated and delivered to the compressor, wherein the compressor and the accumulator may be connected by a suction tube.

The compressor may include a casing and at least one cylinder formed inside the casing, wherein the refrigerant flowing into the casing through the suction tube is distributed into the at least one cylinder.

In accordance with another aspect of the present disclosure, a cooling apparatus is provided. The cooling apparatus includes a refrigerant cycle that involves a compressor, a condenser, an expansion valve, and an evaporator, wherein the refrigerant circulating the refrigerant cycle includes at least one of R290, R600a, R123a, R1234yf, and R1234ze, and wherein a shaft length of the compressor is greater than about 80 mm and less than about 170 mm.

A shaft length of the compressor may be greater than about 88.9 mm and less than about 170 mm.

In accordance with another aspect of the present disclosure, a compressor for compressing and discharging a refrigerant is provided. The compressor includes a casing forming an exterior; a driving unit including a stator, a rotator rotatably arranged inside the stator, and a rotating shaft pressed in the rotator; and a compression unit including a cylinder that forms a compression room and a rolling piston turning around in the compression room with power delivered from the driving unit, wherein the refrigerant includes at least one of R290, R600a, R123a, R1234yf, and R1234ze, and wherein a displacement volume of the compressor is less than about 3 cc.

The rotator may rotate at a speed less than about 6,500 rpm.

The rotating shaft may have a length greater than about 80 mm and less than about 170 mm.

The casing may have internal diameter greater than about 30 mm and less than about 70 mm.

A weight of the compressor is greater than about 0.6 kg and less than about 1.5 kg.

Predetermined oil may be stored in the bottom of the inside of the casing such that the predetermined oil contacts an end of the rotating shaft, wherein the oil has dynamic viscosity ranging from about 68 $mm^2/s$ to about 170 $mm^2/s$.

The compression unit may be arranged such that at least a part of the compression unit contacts an internal part of the casing, wherein the compression unit and the casing may be combined together through multiple spot welds.

The multiple spot welds may include at least one upper spot weld and at least one lower spot weld located between the at least one upper spot weld and the bottom of the casing.

The compression unit may include plates arranged on top and bottom of the cylinder, wherein the multiple spot welds may be located on the plates and the cylinder.

The cylinder may include a first cylinder and a second cylinder located between the first cylinder and the bottom of the casing, wherein the plate may include a top plate arranged on the top of the first cylinder and a bottom plate arranged on the bottom of the second cylinder, and wherein the spot welds may be located on the top plate and the second cylinder.

The casing may include an inlet through which the refrigerant separated from an accumulator flows into the casing.

The cylinder may include multiple cylinders that form compression rooms partitioned from each other, wherein the refrigerant flowing in through the inlet may be distributed to the multiple cylinders.

The cylinder may include a first cylinder forming a first compression room and a second cylinder forming a second compression room, wherein the refrigerant flowing in through the inlet may alternately flow into the first and second compression rooms.

Other aspects, advantages, and salient features of the disclosure will become apparent to those skilled in the art from the following detailed description, which, taken in conjunction with the annexed drawings, discloses exemplary embodiments of the disclosure

BRIEF DESCRIPTION OF THE DRAWINGS

The above and other features and advantages of the present disclosure will become more apparent by describing in detail exemplary embodiments thereof with reference to the attached drawings in which.

Throughout the drawings, like reference numerals will be understood to refer to like parts, components, and structures.

DETAILED DESCRIPTION

Figure 1:
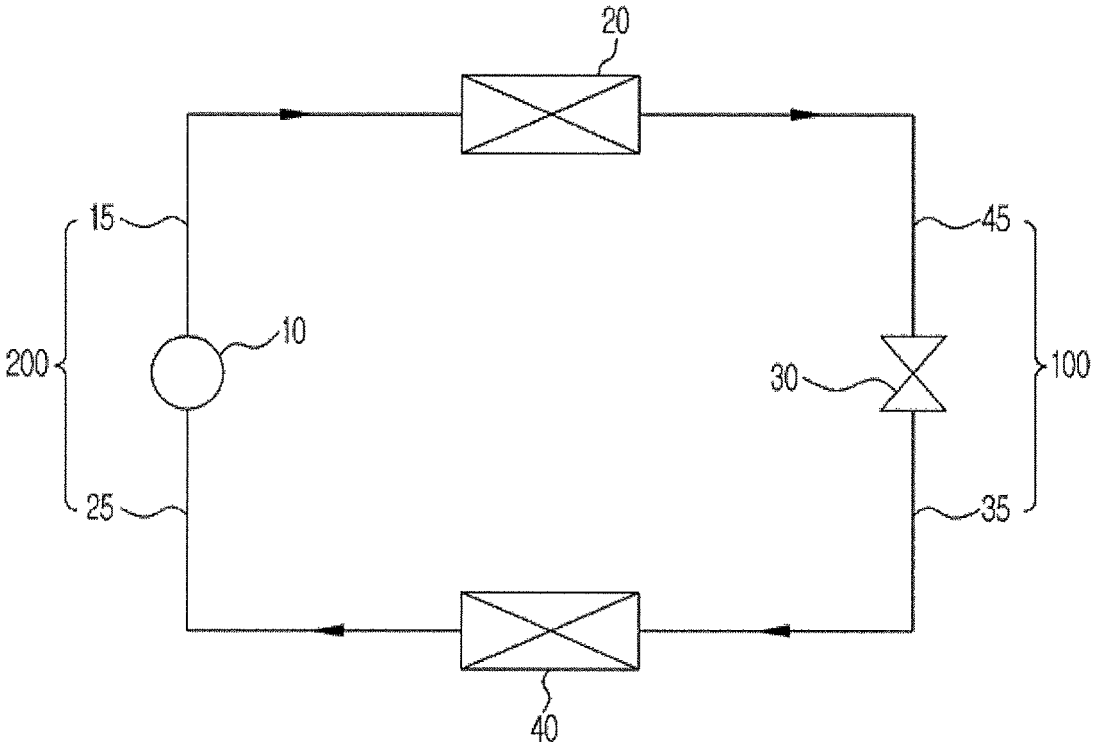
FIG. 1 illustrates a refrigerant cycle of a cooling apparatus, according to an embodiment of the present disclosure.

The present disclosure will now be described more fully with reference to the accompanying drawings, in which exemplary embodiments of the disclosure are shown. The disclosure may, however, be embodied in many different forms and should not be construed as being limited to the embodiments set forth herein; rather, these embodiments are provided so that this disclosure will be thorough and complete, and will fully convey the concept of the disclosure to those skilled in the art. Like reference numerals in the drawings denote like elements, and thus their description will be omitted.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure. The terminology used herein is for the purpose of describing particular embodiments only and is not intended to be limiting of the invention. It is to be understood that the singular forms "a," "an," and "the" include plural references unless the context clearly dictates otherwise.

The term "include (or including)" or "comprise (or comprising)" is inclusive or open-ended and does not exclude additional, unrecited elements or method steps. "Unit", "module", "block", etc. used herein each represent a unit for handling at least one function or operation, and may be implemented in hardware, software, or a combination thereof.

The invention may, however, be embodied in many different forms and should not be construed as being limited to the embodiments set forth herein; rather, these embodiments are provided so that this disclosure will be thorough and complete, and will fully convey the concept of the invention to those skilled in the art. Like reference numerals in the drawings denote like elements, and thus their description will be omitted.

Reference will now be made in detail to embodiments, examples of which are illustrated in the accompanying drawings, wherein like reference numerals refer to the like elements throughout.

FIG. 1 illustrates a refrigerant cycle of a cooling apparatus, according to an embodiment of the present disclosure.

A refrigerant cycle may involve a compressor 10, a condenser 20, an expansion valve, or expansion device, 30, and an evaporator 40. In the refrigerant cycle, a refrigerant circulates through a series of procedures, compression-condensation-expansion-evaporation procedures, thereby cooling an object to be cooled by means of heat exchange between the refrigerant and the object.

The compressor 10 compresses a gas refrigerant under high temperature and high pressure and discharges the compressed gas refrigerant, which in turn flows into the condenser 20. The condenser 20 condenses the gas refrigerant into a liquid, releasing heat to the surroundings.

The expansion valve 30 expands the high temperature and high pressure liquid refrigerant condensed by the condenser 20 to a low pressure liquid refrigerant. The evaporator 40 evaporates the refrigerant expanded by the expansion valve 30. The evaporator 40 attains cooling effect by means of heat exchange with the object to be cooled using latent heat of vaporization of the refrigerant, and returns the low temperature and low pressure gas refrigerant to the compressor 10. The cooling apparatus for cooling an object to be cooled may use the refrigerant cycle.

The refrigerant circulating inside the cooling apparatus may include at least one of R290, R600a, R123a, R1234yf, and R1234ze. Cooling performance of the cooling apparatus may be less than about 2 KW. The cooling apparatus refers to an apparatus for cooling an object to be cooled, and the cooling performance refers to a capacity of the cooling apparatus.

The compressor 10, the condenser 20, the expansion valve 30, and the evaporator 40 may be connected by pipes 100 and 200 for the refrigerant to pass through. The refrigerant passing through the compressor 10 is in a gas phase and the refrigerant passing through the expansion valve 30 is in a liquid phase. Accordingly, a pipe connected to the compressor 10 is called a gas-side pipe 200, and a pipe connected to the expansion valve 30 is called a liquid-side pipe 100.

The gas-side pipe 200 includes a first gas-side pipe 15 that connects the condenser 20 and the compressor 10, and a second gas-side pipe 25 that connects the evaporator 40 and the compressor 10. The liquid-side pipe 100 includes a first liquid-side pipe 45 that connects the condenser 20 and the expansion valve 30, and a second liquid-side pipe 35 that connects the evaporator 40 and the expansion valve 30.

The liquid-side pipe 100 and gas-side pipe 200 may be formed as cylinders having a predetermined thickness. For example, an internal diameter of the liquid-side pipe 100 may be less than 4.2 mm. However, the internal diameter of the liquid-side pipe 100 may be greater than 1.1 mm for the refrigerant to pass through. Accordingly, the internal diameter of the liquid-side pipe 100 may be greater than 1.1 mm and less than 4.2 mm.

As another example, the internal diameter of the gas-side pipe 200 may be less than 6.5 mm. The internal diameter of the gas-side pipe 200 may be greater than 1.5 mm as well, and accordingly, the internal diameter of the gas-side pipe 200 may be greater than 1.5 mm and less than 6.5 mm.

Figure 2:
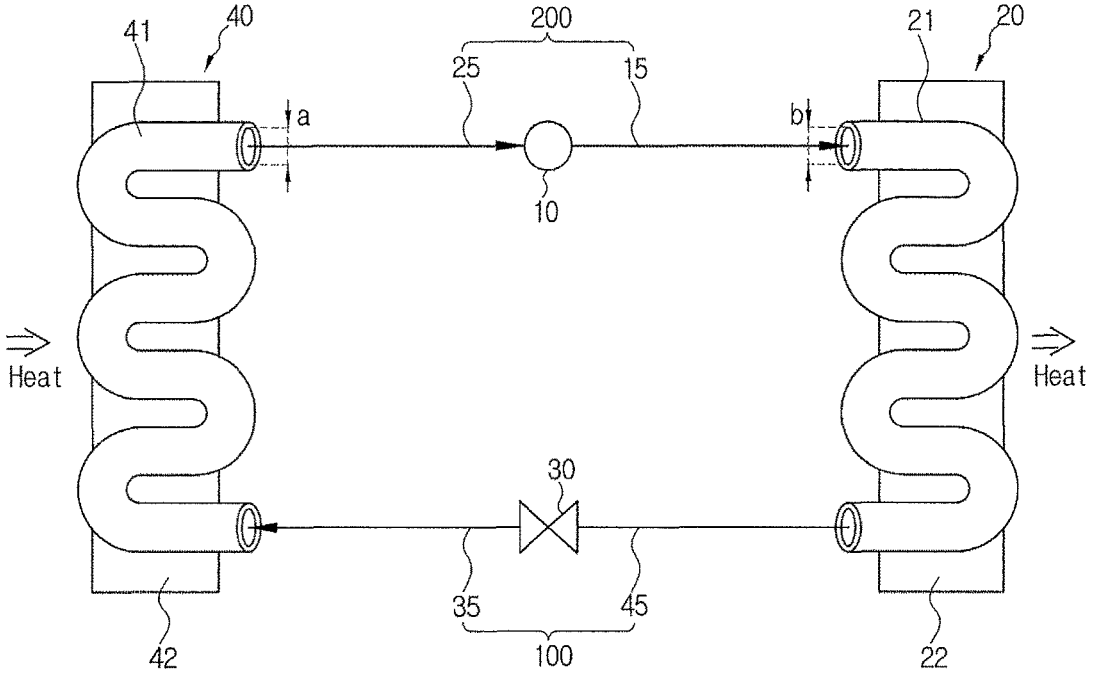
FIG. 2 illustrates a heat exchanger of a cooling apparatus, according to an embodiment of the present disclosure.

FIG. 2 illustrates a heat exchanger of a cooling apparatus, according to an embodiment of the present disclosure.

The condenser 20 and the evaporator 40 are basically heat exchangers, in which a refrigerant exchanges heat with an object to be cooled while flowing through. Although illustrated herein in the form of heat transfer tubes 21 and 41 in which the refrigerant performs heat exchange while flowing through, the heat exchangers may have various other forms. The heat transfer tubes 21 and 41 may be formed to be in the form of cylinders having a predetermined thickness. Heat exchanger fins 22 and 42 may be attached to the heat transfer tubes 21 and 41, respectively, to increase heat exchange efficiency.

The heat transfer tube 21 formed on the side of the condenser 20 is referred to as a heating heat transfer tube because it releases heat to the surrounding during the transformation of the gas refrigerant to a liquid refrigerant. The heat transfer tube 41 formed on the side of the evaporator 40 is referred to as a cooling heat transfer tube because it absorbs heat from the surrounding during the phase transition from the liquid refrigerant to the gas refrigerant.

An internal diameter b of the heat transfer tube 21 of may have a predetermined diameter. For example, the internal diameter b of the heating heat transfer tube 21 may be less than 5.0 mm. However, the heating heat transfer tube 21 may have an internal diameter b greater than 2.0 mm for the refrigerant to pass through. Accordingly, the internal diameter b of the heating heat transfer tube 21 may be greater than 2.0 mm and less than 5.0 mm.

An internal diameter a of the cooling heat transfer tube 41 may also have a predetermined diameter. For example, the internal diameter a of the cooling heat transfer tube 41 may be less than 7.0 mm. The internal diameter a of the cooling heat transfer tube 41 may be greater than 1.5 mm, and accordingly, the internal diameter a of the cooling heat transfer tube 41 may be greater than 1.5 mm and less than 7.0 mm.

Figure 3:
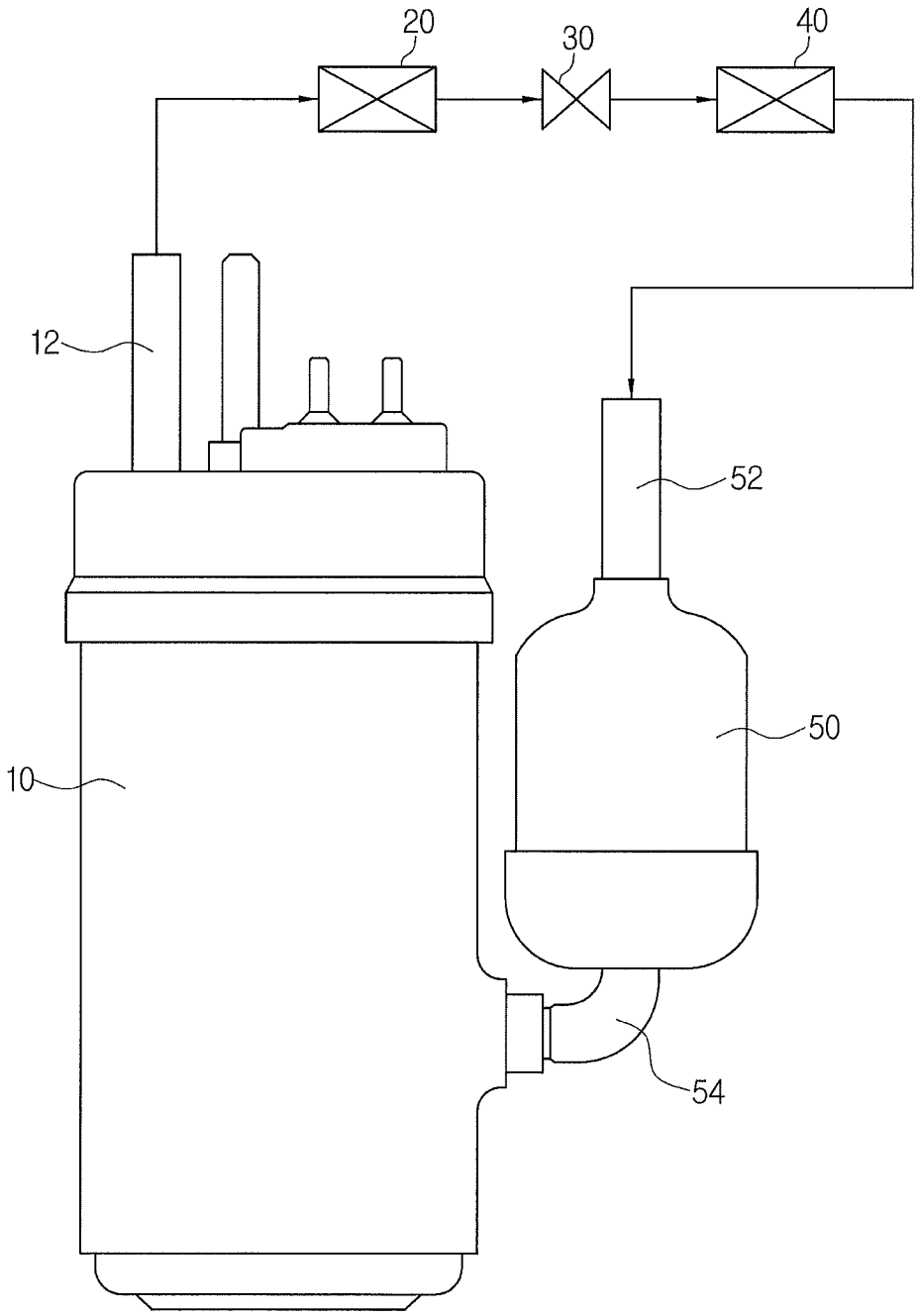
FIG. 3 illustrates a compressor, according to an embodiment of the present disclosure.
Figure 4:
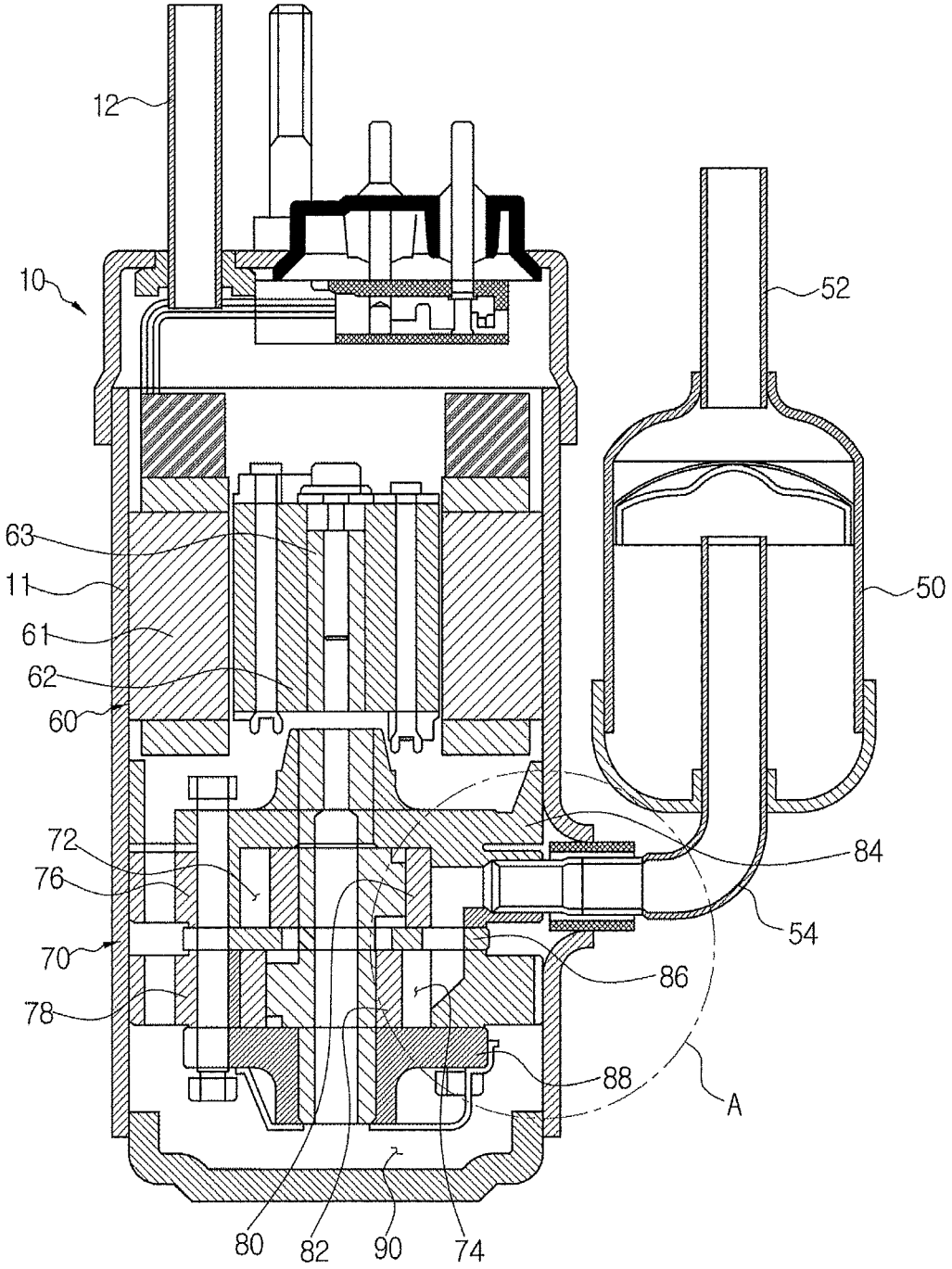
FIG. 4 illustrates a cross sectional view of a compressor, according to an embodiment of the present disclosure.

FIG. 3 illustrates the compressor 10, according to an embodiment of the present disclosure, and FIG. 4 illustrates a cross sectional view of the compressor 10, according to an embodiment of the present disclosure.

A refrigerant discharged from the evaporator 40 may flow through an accumulator 50 into the compressor 10. The accumulator 50 may be arranged adjacent to the compressor 10, and the accumulator 50 and the compressor 10 may be connected by a suction pipe 54. On one end of the compressor 10, a blaster tube 12 may be formed to discharge a compressed refrigerant into the condenser 20.

The accumulator 50 is installed to prevent refrigerant not transformed into a gas phase (i.e., refrigerant that has remained in the liquid phase even after being discharged from the evaporator 40) to remain among low temperature and low pressure refrigerants discharged from the evaporator 40 from flowing into the compressor 10. The refrigerant discharged from the evaporator 40 flows through a connecting tube 52 into the accumulator 50. Since the compressor 10 may not compress a liquid refrigerant, the accumulator 50 has only a refrigerant in the gas phase flow to the compressor 10. In other words, only the liquid refrigerant is left in the accumulator while the gas refrigerant flows into the compressor 10.

The compressor 10 may include a casing 11, a driving unit 60 and a compression unit 70 arranged inside the casing 11. The driving unit 60 may be installed in an upper part of the inside of the casing 11, and the compression unit 70 may be installed in a lower part of the inside of the casing 11.

The driving unit 60 may include a cylindrical stator 61 fixed inside the casing 11, and a rotator 62 rotatably installed inside the stator 61. A rotating shaft 63 may be pressed in the center of the rotator 62 and combined with the rotator 62.

With power applied, the rotator 62 and the rotating shaft 63 combined with the rotator 62 rotate, and accordingly drive the compression unit 70. The driving unit 60 may work at any speed less than 6,500 rpm. In other words, the rotator 62 may rotate at any speed less than 6,500 rpm, delivering rotary power to the compression unit 70.

The compression unit 70 may include a plurality of cylinders, compression rooms and rolling pistons. For example, the compression unit 70 may include cylinders 76 and 78 that form compression rooms 72 and 74, respectively, and rolling pistons 80 and 82 which turn around in the compression rooms 72 and 74 with the delivered rotary power. The plurality of cylinders 76 and 78, thus forming a plurality of compression rooms 72 and 74 partitioned from each other. The compression unit 70 may also include a plurality of plates 84, 86, and 88 that form the compression rooms 72 and 74 by covering top and bottom of each of the plurality of cylinders 76 and 78.

Referring to FIG. 4, a first cylinder 76 and a second cylinder 78 arranged between the first cylinder 76 and the bottom of the casing 11 are shown. The first cylinder 76 may form the first compression room 72 and the second cylinder 78 may form the second compression room 74. The first rolling piston 80 and the second rolling piston 82 may be located in the first compression room 72 and the second compression room 74, respectively. Further, the plates 84, 86, and 88 may be a top plate 84 arranged on the top of the first cylinder 76, a bottom plate 88 arranged on the bottom of the second cylinder 78, and a center plate 86 arranged between the first cylinder 76 and the second cylinder 78.

The rotating shaft 63 extended from the driving unit 60 may be installed by passing through the center of the first compression room 72 and the second compression room 74. The rotating shaft 63 may be connected to the first rolling piston 80 and the second rolling piston 82 formed in the first compression room 72 and the second compression room 74, respectively. The compressor 10 may include a rotating shaft 63 that extends a length of an inside of the casing 11 of the compressor 10. A shaft length of the rotating shaft 63 refers to a vertical length of the rotating shaft 63. The shaft length of the rotating shaft 63 may range from about 80 mm to about 170 mm. More specifically, the shaft length of the rotating shaft 63 may range from about 88.9 mm to about 170 mm.

The first and second rolling pistons 80 and 82 may be combined with the rotating shaft 63, eccentrically turning around inside the compression rooms 72 and 74, respectively. With the structure, the eccentric turning movement in the compression rooms 72 and 74 may compress a medium. The first and second rolling pistons 80 and 82 may be combined with the rotating shaft 63 with different directions of eccentricity. For example, the refrigerant may be compressed 180 degrees out of phase in the first and second rolling pistons 80 and 82.

The compressor 10 having such rolling pistons 80 and 82 that eccentrically rotate is referred to as a rotary compressor. The compressor 10 may be formed to have a displacement volume less than about 3 cc. The displacement volume results from combination of volumes of the first and second compression rooms 72 and 74.

A weight of the compressor 10 may be less than about 1.5 kg. The weight of the compressor 10 refers to a weight, exclusive of, for example, the accumulator 50. For example, the weight of the compressor 10 may range from about 0.6 kg to about 1.5 kg.

An internal diameter of the casing 11 of the compressor 10 may be less than about 70 mm. The internal diameter of the casing 11 of the compressor 10 refers to a diameter of a horizontal section of the casing 11. For example, the internal diameter of the compressor 10 may range from about 30 mm to about 70 mm.

On the bottom of the inside of the casing 11, an oil storage room 90 may be formed to store a predetermined oil to contact an end of the rotating shaft 63. The oil moves up and down along the rotating shaft 63, reducing friction in, for example, the compression unit 70.

The oil may be a high viscous oil having a dynamic viscosity. For example the dynamic viscosity may range from about 68 square millimeters per second ($mm^2/s$) to 170 $mm^2/s$. The oil may be at least one of Polyol ester (POE) and Polyvinyl ether (PVE).

Figure 5:
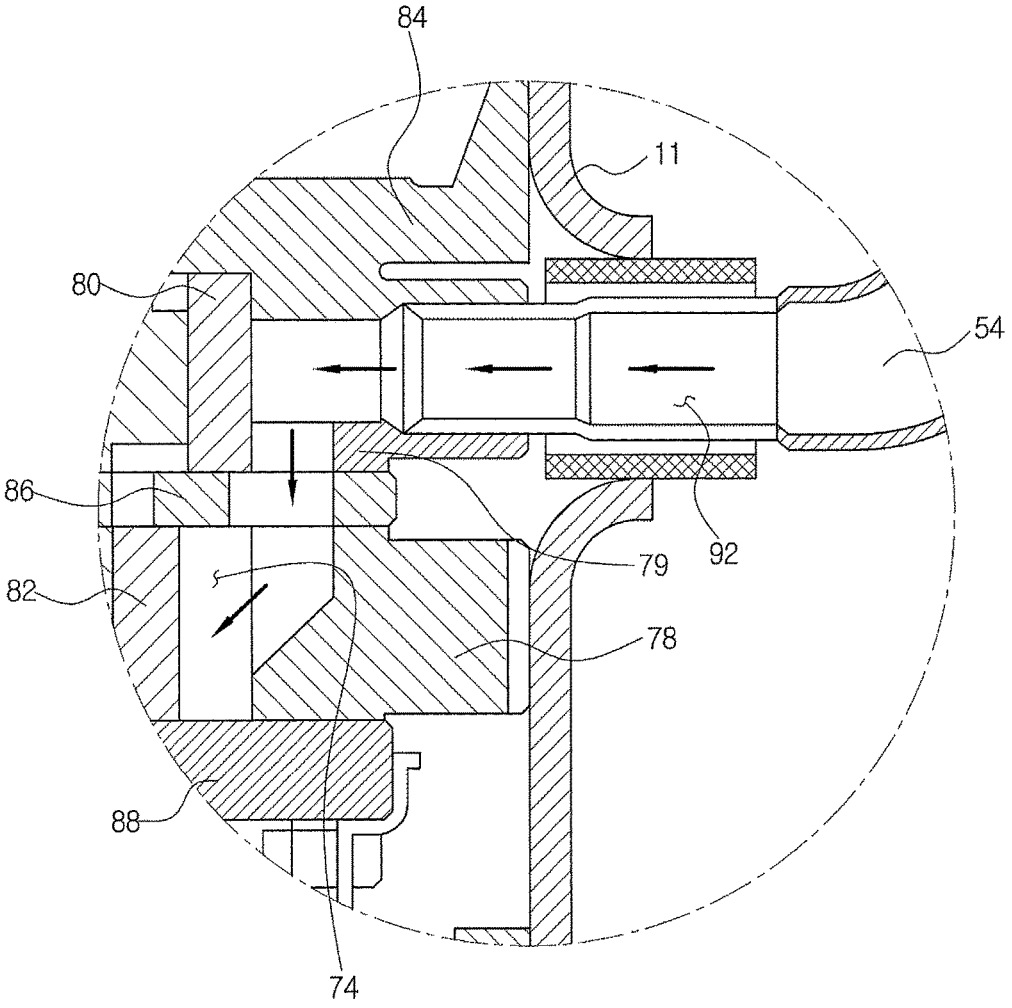
FIG. 5 illustrates an enlargement of part 'A' of FIG. 4.

FIG. 5 illustrates an enlargement of part 'A' of FIG. 4. Part 'A' shows a fluid path through which a refrigerant flowing from the accumulator 50 to the compressor 10 moves.

The refrigerant having passed through the accumulator 50 passes through the suction tube 54 to an inlet 92 of the compressor 10. As shown in FIGS. 3 to 5, the accumulator 50 and the compressor 10 are connected by the suction tube 54, and the refrigerant flows into the compressor 10 through the inlet 92.

The refrigerant flowing to the inside of the casing 11 through the inlet 92 may be distributed to respective cylinders 76 and 78. As discussed above, since the first and second rolling pistons 80 and 82 are operated 180 degrees out of phase, the refrigerant may alternately flow into the first and second compression rooms 72 and 74.

In FIG. 5, it is shown that the refrigerant flowing through the inlet 92 flows into the second compression room 74. At this time, the first rolling piston 80 is eccentrically rotating so as to extend toward the inlet 92, hindering the refrigerant from flowing into the first compression room 72, while the second rolling piston 82 is eccentrically rotating so as to extend toward the opposite of the inlet 92, helping the refrigerant flow into the second compression room 74. That is, as the first and second rolling pistons 80 and 82 eccentrically rotate alternately, the refrigerant may be distributed into the first and second compression rooms 72 and 74.

Figure 6:
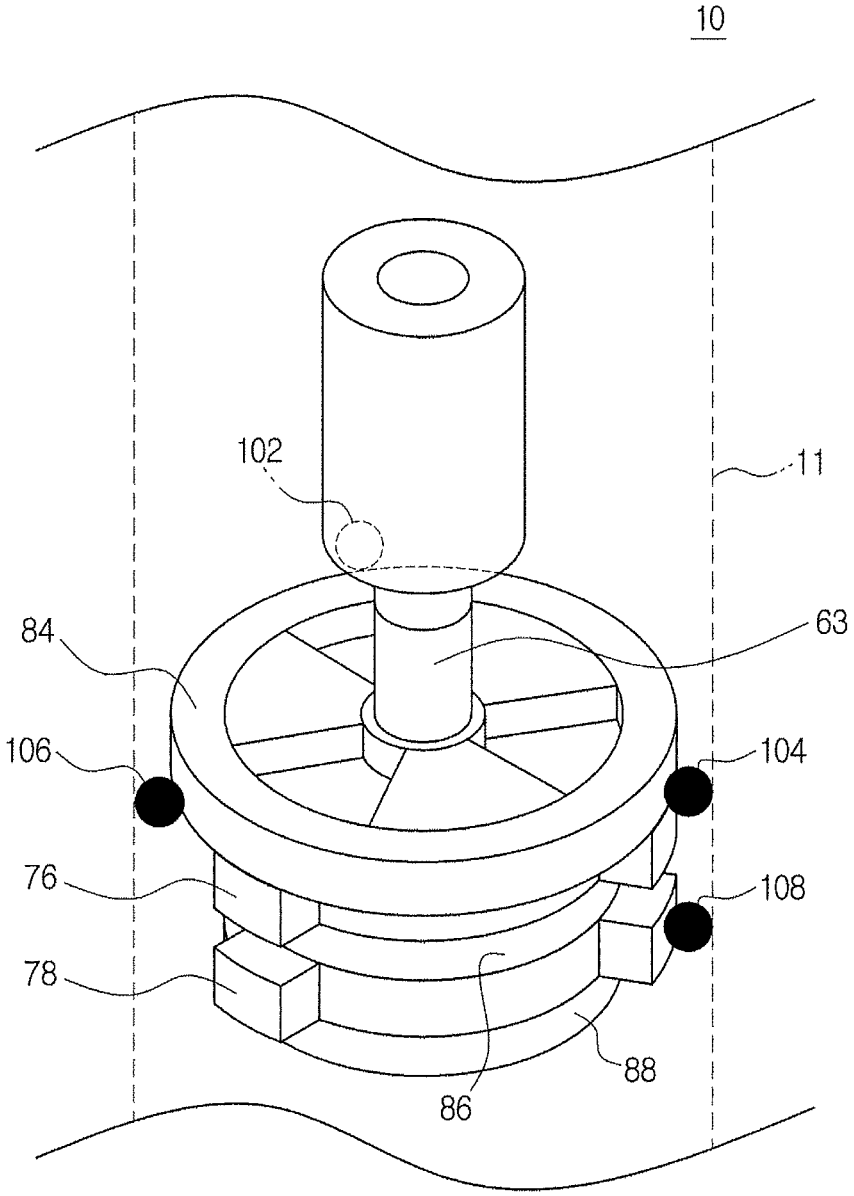
FIG. 6 illustrates spot welds of a compressor, according to an embodiment of the present disclosure.

FIG. 6 illustrates a spot weld (see e.g., spot welds 102, 104, 106, and 108) of the compressor 10, according to an embodiment of the present disclosure.

The compression unit 70 may be arranged such that at least a part of the compression unit 70 contacts the inside of the casing 11. The casing 11 and the compression unit 70 may be welded together such that the compression unit 70 is combined with the inside of the casing 11 to compress the refrigerant. The compression unit 70 may be combined with the inside of the casing 11 by way of a single spot weld on a plate and/or cylinder or multiple spot welds on a plurality of plates and/or cylinders. For example, spots where the casing 11 and the compression unit are welded together may be referred to as spot welds 102, 104, 106, and 108.

The multiple spot welds 102, 104, 106, and 108 are to reliably combine the compression unit 70 and the casing. The multiple spot welds 102, 104, 106, and 108 may be located on plates 84, 86, and 88, and cylinders 76 and 78. The multiple spot welds 102, 104, 106, and 108 may include at least four separate spot welds 102, 104, 106, and 108.

The multiple spot welds 102, 104, 106, and 108 may include at least one upper spot weld 102, 104, and/or 106, and at least one lower spot weld 108 located between the at least one upper spot weld 102, 104, and/or 106 and the bottom of the casing 11.

In FIG. 6, three upper spot welds 102, 104, 106 and one lower spot weld 108 are shown. The three upper spot welds 102, 104, and 106 are arranged apart on the top plate 84 at certain intervals, and the lower spot weld 108 is arranged on a side of the second cylinder 78. The locations of spot welds 102, 104, 106, 108 may be changed to optimum locations based on the structure of the compressor 10.

In accordance with the embodiments of the present disclosure, a small-sized and high-efficient cooling apparatus and compressor may be provided. The cooling apparatus and compressor may restrict behaviors of their components to achieve miniaturization and high efficiency.

Several embodiments have been described, but a person of ordinary skill in the art will understand and appreciate that various modifications can be made without departing the scope of the present disclosure. Thus, it will be apparent to those ordinary skilled in the art that the disclosure is not limited to the embodiments described, which have been provided only for illustrative purposes.

What is claimed is:

1. A cooling apparatus comprising:

an evaporator to evaporate a refrigerant received thereof, the refrigerant circulating inside the cooling apparatus includes at least one of R290, R600a, R123a, R1234vf, and R1234ze:

a rotary compressor having a displacement volume less than 3 cc and to compress the refrigerant received from the evaporator, the rotary compressor including:

a casing;

a first cylinder;

a second cylinder located between the first cylinder and a bottom of the casing;

a top plate arranged on a top of the first cylinder, and a bottom plate arranged on a bottom of the second cylinder; and a condenser to condense the refrigerant discharged from the rotary compressor; and an expansion valve to expand the refrigerant discharged from the condenser, wherein the second cylinder is combined with the casing through at least one spot weld and the top plate is combined with the casing through at least three separate spot welds, and the refrigerant is flowed into the casing through a single suction tube and distributed into the first cylinder and the second cylinder.

2. The cooling apparatus of claim 1, wherein cooling performance of the cooling apparatus is less than 2 kW.

3. The cooling apparatus of claim 1, wherein the rotary compressor, the condenser, the expansion valve, and the evaporator are connected by pipes, wherein the pipes comprise liquid-side pipes that connect the evaporator and the rotary compressor, and the rotary compressor and the condenser, and gas-side pipes that connect the condenser and the expansion valve, and the expansion valve and the evaporator, wherein an internal diameter of the liquid-side pipes is less than 4.2 mm, and wherein an internal diameter of the gas-side pipes is less than 6.5 mm.

4. The cooling apparatus of claim 1, wherein the condenser and the evaporator comprise heat transfer pipes in which the refrigerant undergoes heat exchange while flowing through the heat transfer pipes, wherein the heat transfer pipes comprise a condensation heat transfer tube formed in the condoncor and an evaporation heat transfer tube formed in the evaporator, wherein an internal diameter of the condensation heat transfer tube is less than 5.0 mm, and wherein an internal diameter of the evaporation heat transfer tube is less than 7.0 mm.

5. The cooling apparatus of claim 1, wherein a weight of the rotary compressor is less than 1.5 kg.

6. The cooling apparatus of claim 1, wherein an internal diameter of a casing of the rotary compressor is less than 70 mm.

7. The cooling apparatus of claim 1, wherein a shaft length of a rotating shaft of the rotary compressor is less than 170 mm.

8. The cooling apparatus of claim 1, wherein oil having a dynamic viscosity ranging from 68 $mm^2/s$ to 170 $mm^2/s$ is stored in the casing.

9. The cooling apparatus of claim 8, wherein the oil comprises at least one of Polyol ester (POE) and Polyvinyl ether (PVE).

10. The cooling apparatus of claim 1, wherein the rotary compressor includes a driver to deliver power to the rotary compressor, and wherein the driver operates at a speed less than 6,500 rpm.

11. The cooling apparatus of claim 1, wherein the at least one cylinder includes a first cylinder and a second cylinder located between the first cylinder and a bottom of the casing, and wherein the spot welds are located on the at least one of the plates and the second cylinder.

12. The cooling apparatus of claim 1, further comprising:

an accumulator installed on a side of the rotary compressor to separate and deliver the refrigerant discharged from the evaporator to the rotary compressor, wherein the rotary compressor and the accumulator are connected by a suction tube.

13. The cooling apparatus of claim 12, wherein the refrigerant flowing into the casing through the suction tube is distributed into the at least one cylinder.

* * * * *